United States Patent [19]

Lamboy et al.

[11] Patent Number: 4,877,065

[45] Date of Patent: Oct. 31, 1989

[54] DECANTING DEVICE FOR LIQUIDS, E.G. PERMANENT WAVE AGENTS

[75] Inventors: Peter Lamboy, Weiterstadt; Franz Steigerwald, Griesheim; Karlheinz Zulauf, Hoechst-Hassenroth, all of Fed. Rep. of Germany; Harmut Ginnow-Markert, Minneapolis, Minn.

[73] Assignee: Wella Aktiengesellschaft, Darmstadt, Fed. Rep. of Germany

[21] Appl. No.: 557,281

[22] PCT Filed: Mar. 16, 1983

[86] PCT No.: PCT/EP83/00075

§ 371 Date: Jan. 26, 1984

§ 102(e) Date: Jan. 26, 1984

[87] PCT Pub. No.: WO83/03234

PCT Pub. Date: Sep. 29, 1983

[30] Foreign Application Priority Data

Mar. 19, 1982 [DE] Fed. Rep. of Germany ..... 3210154

[51] Int. Cl.[4] ..... B65B 3/06; B65B 3/16

[52] U.S. Cl. ..... 141/18; 141/113; 141/319; 141/329; 222/181

[58] Field of Search ..... 141/1, 14–19, 141/21, 22, 113, 23, 285, 291–296, 301, 302, 311 R, 319–325, 329, 351, 352, 382; 251/335 B; 222/80, 81, 481, 481.5, 181, 185, 563, 488, 490, 547, 562; 220/256, 373; 215/307, 309, 311, 312

[56] References Cited

U.S. PATENT DOCUMENTS

| | | | |
|---|---|---|---|
| 2,318,462 | 5/1943 | Burdick | 141/334 |
| 2,851,201 | 9/1958 | Poltras et al. | 222/481 |
| 3,216,418 | 11/1965 | Scislowicz | 141/302 X |
| 3,402,747 | 9/1968 | Tissot-Dupont | 141/348 |
| 3,638,499 | 2/1972 | Saint-Andre | 251/DIG. 4 |
| 3,683,978 | 8/1972 | Jones et al. | 141/285 |
| 3,848,776 | 11/1974 | Schieser | 222/181 X |
| 4,142,651 | 3/1979 | Leopoldi et al. | 222/185 |
| 4,197,884 | 4/1980 | Maran | 141/383 |
| 4,288,007 | 9/1981 | Rogers et al. | 222/181 X |
| 4,391,308 | 7/1983 | Steiner | 141/18 |
| 4,481,986 | 11/1984 | Meyers | 141/4 |

FOREIGN PATENT DOCUMENTS

| | | | |
|---|---|---|---|
| 249761 | 11/1944 | Switzerland . | |
| 2032007 | 4/1980 | United Kingdom | 141/18 |
| 8303234 | 9/1987 | World Int. Prop. O. | 141/18 |

*Primary Examiner*—Ernest G. Cusick
*Attorney, Agent, or Firm*—Michael J. Striker

[57] ABSTRACT

A lower part (2) of a frame (1) comprises a filling valve (4) with an upwardly projecting filling plug which can be connected to a filling closure (8) in the base of a mountable portion container (5). A support (9) which projects upwardly from the lower part (2) of the frame (1) bears a dispensing connector (10) which is connected via a pipe (13) to the filling valve (4). A storage container (12), e.g. for a liquid permanent wave agent, can be mounted on the connector (10). The filling valve (4) is opened when the portion container (5) is mounted.

21 Claims, 8 Drawing Sheets

DECANTING DEVICE FOR LIQUIDS, E.G. PERMANENT WAVE AGENTS

BACKGROUND OF THE INVENTION

Technical Field

The present invention relates to a decanting device for decanting liquids, in particular liquid permanent wave agents, from a storage container provided with a dispensing closure into a portion container provided with a filling closure The decanting of liquids from a large storage container into a smaller container is connected with great difficulties in all those cases in which a possible loss of liquid occurring during decanting is felt to be particularly troublesome, for example on account of the resulting contamination, or when the contact with air which occurs during free decanting causes, for example, the escape of noxious vapors or unpleasant smells, or when an undesired reaction of the liquid with atmospheric oxygen is to be feared.

Several of these considerations are to be taken into account when decanting liquid permanent wave agents, are in contact with too much of atmospheric oxygen which should be primarily avoided because traditional permanent wave agents contain oxidizing constituents.

For example, when decanting a liquified gas into lighters from a storage container which is under high pressure, it is known to provide a filling closure constructed as a valve at the base of the lighter and to mount it directly on the dispensing closure of the storage container, which is also constructed as a valve. As a result of the pressure exerted thereby the dispensing closure of the storage container opens and allows the pressurized liquefied gas to flow into the gas container of the lighter. This type of decanting requires a relatively high pressure in the storage container, so losses during decanting are unavoidable. However, in the given example of filling gas lighters these leakages are to a large extent insignificant because the emerging liquefied gas evaporates immediately and does not have any unpleasant or noxious effects. However, on account of the required high overpressure and possible leakages, this measure is not suitable for decanting liquid permanent wave agents or similar liquids.

A possibility for decanting liquid permanent wave agents or the like consists in providing the storage container with a tubular delivery nozzle which is inserted into a filling opening if the portion container. However, in this connection it is necessary to lift and tilt the storage container during each decanting operation, so that there is not only the risk of liquid losses but also undesired contact with atmosheric oxygen occurs.

It must be taken as a starting point that for the decanting of liquid permanent wave agents there is the requirement of simplifying the decanting process so that the user can carry it out with one hand, and, while avoiding losses of liquid and restricting as far as possible the contact of the liquid with atmospheric oxygen, metering of the amount of liquid taken up into the portion container is to be made possible in a particularly simple manner so that the user can take the amount of liquid for the respective use.

SUMMARY OF THE INVENTION

The object of the invention is therefore to produce a decanting device with which decanting can be carried out rapidly and simply, and losses of liquid would to be completely avoided and a contact of the liquid with the atmospheric oxygen would be excluded as far as possible. No handling of the storage container should be necessary during and between the individual decanting processes.

According to the invention a filling valve, which is connectible to the filling closure of the portion container, is arranged in a lower part of a frame; and a support, which is connected to the lower part of the frame, bears a dispensing connector which is arranged at a distance laterally and above the filling valve and is connectible to the dispensing closure of the storage container.

The storage container with its dispensing closure is connected to the dispensing connector. The flow connection between the dispensing connector and the filling valve can occur in a simple manner by a line, for example a flexible pipe. As a result of the difference in height between the storage container and the filling valve it is achieved that the liquid appears at the filling valve with an overpressure which is relatively slight but is sufficient for the decanting process. The liquid rises upwards in the connected portion container from the filling closure at its base until a desired liquid level is reached in the portion container. In this case the liquid comes into contact with atmospheric oxygen as little as possible, especially as the liquid in the portion container rises slowly and the liquid surface in the portion container remains smooth. Any free liquid flow with a considerable surface increase is thereby avoided.

In order to simplify use it is aimed to keep the manipulations required for the decanting process to a minimum, and for example it is desired to dispense with separate operation of the filling valve.

To this end in a further development of the invention it is provided that the filling valve comprises a hollow filling plug which projects upwards and can be inserted into the filling closure of the portion container; at least one movable, spring-loaded valve actuator projects from a base surrounding the filling plug, for supporting the portion container; and the valve actuator is connected to a valve closure member of the filling valve. The filling valve therefore opens automatically as soon as a portion container is mounted and the arrangement of the valve actuator or actuators at the base for the portion container ensures that the filling valve is only opened when the portion container is placed on the base, and it is thus ensured that the filling plug is inserted completely into the filling closure of the portion container. The filling valve closes as soon as the portion container is lifted from the base so as to prevent the liquid from issuing from the filling plug after the portion container has been taken off. Contamination by escaping liquid is thereby avoided as far as possible.

According to a particularly advantageous embodiment of the filling valve it is provided that the valve actuator and the valve closure member are connected to a lower, movable valve housing supported on a spring; and the lower, movable valve housing part is connected to an upper valve housing which is rigid with the frame and connected to the base and the filling plug by a movable valve housing seal which is preferably a bellows. Thereby transition points to be sealed for movable components which could tend to leak are avoided on the filling valve.

One embodiment of the present invention has proved to be particularly advantageous in which the storage container is provided with lateral undercut recesses into which projections mounted on the support engage as a bayonet closure. Thus a secure fastening of the storage container on the support is achieved so that, even in the case of a very inappropriate handling and even when decanting, no liquid can emerge.

In order to prevent the storage container from being necessarily closed before it is taken away from the decanting device, which would lead to contamination and losses of liquid, in a further advantageous form of the invention it can be provided that the dispensing closure of the storage container is a dispensing valve and comprises a valve screw cap bearing an inwardly projecting valve seat lip, which in the closed state sealingly abuts against a central valve seat cylinder rigidly connected to the storage container; and the valve screw cap comprises longitudinal ribs extending axially parallel on its outer side, into which guide ribs—which also extend axially parallel—of the dispensing connector engage.

Since the valve screw cap is connected to the dispensing connector of the support by interlocking ribs so as to be axially displaceable but non-rotatable, only the rotation of the storage container, which is required to close the bayonet closure, opens the dispensing valve. The dispensing valve is closed in the case of the opposite rotational movement, which is required in order to release the bayonet closure. In this manner not only is simplification of handling achieved in that the storage container is automatically opened when it is fitted to the support and closed again automatically when it is taken off but it is also ensured that no losses of liquid can occur when the storage container is mounted or taken off.

In order to guarantee a free flow of the liquid to be decanted, various measures are possible in order to ventilate the storage container when liquid is drawn off.

In the simplest manner this ventilation is achieved in that the storage container comprises a closable ventilation opening on its wall lying opposite the dispensing closure. Since the free surface of the liquid in the storage container is particularly great on account of its size, and because the liquid remains longer in the storage container in contrast to the portion container, it is particularly important that the liquid surface in the storage container be distributed as little as possible. In this case it is particularly important that the liquid is drawn off on the underside of the storage container.

In order not to allow the ventilation opening to be opened for an unnecessarily long period of time it is constructed so as to be closable. The amount of work required for the opening and closing of the ventilation opening can be avoided and the ventilation process limited to those periods of time in which ventilation is in fact necessary, i.e. only during the decanting of the liquid into the portion container, by mounting a ventilation valve in the base in addition to the filling plug, the valve actuator of the valve projecting upwardly above the base and being connectible via a ventilation line to the ventilation connection in the dispensing connector. Ventilation of the storage container only occurs when the portion container has been mounted.

Further advantageous forms of the invention constitute the subject-matter of the sub-claims.

The invention will be described further, by way of example, with reference to the accompanying drawings.

DETAILED DESCRIPTION OF THE PREFERRED EMBODIMENTS

Figure 1A:
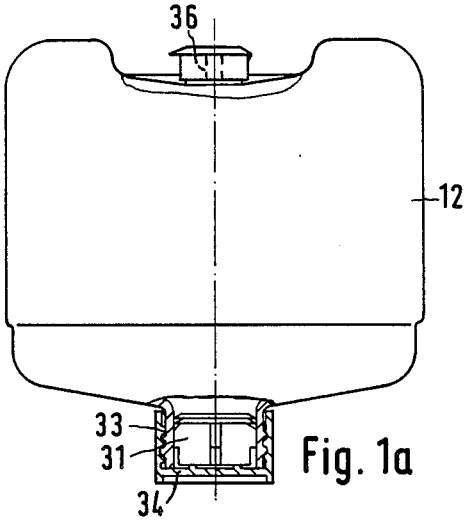
FIG. 1*a* shows a storage container used in the device according to FIG. 1, in the closed state.
Figure 1:
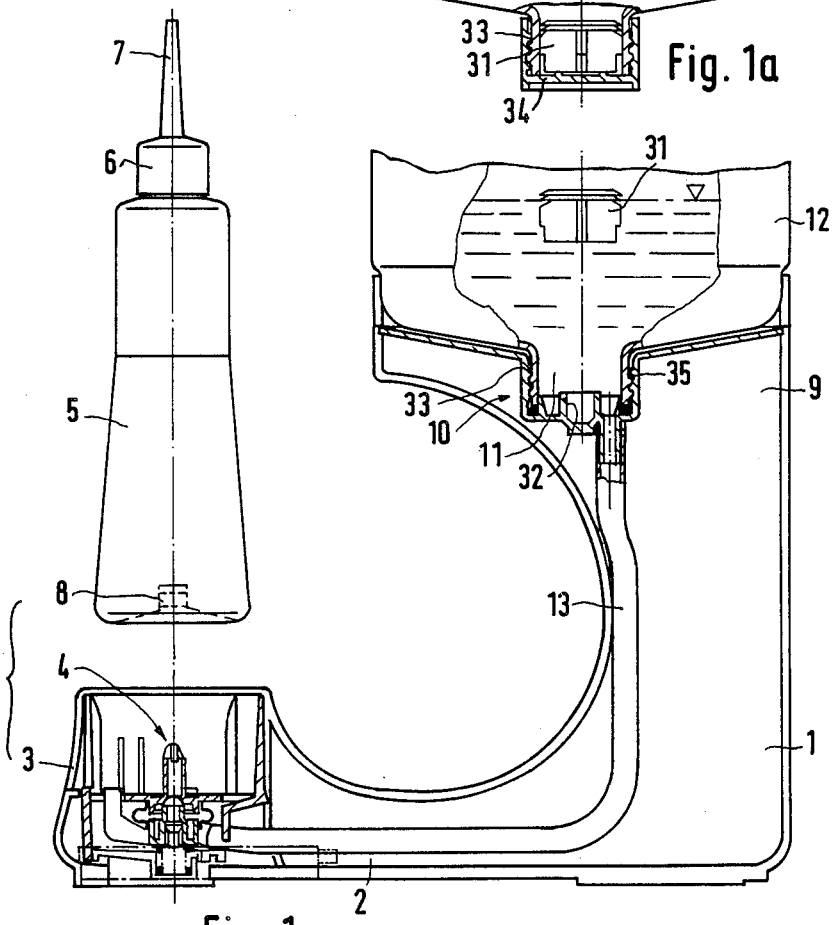
FIG. 1 shows a decanting device for decanting a liquid permanent wave agent, in section, a portion container being illustrated in the raised state.

The decanting device shown in FIG. 1 comprises a frame or housing 1 consisting of two housing shells, the lower part 2 of the frame 2 comprising a filling valve 4 inside an upright rim 3. A bottle-shaped portion container 5, which is made from at least partially transparent plastics and bears a screw cap 6 with a tubular delivery nozzle 7, has at its base a filling closure 8 which is only indicated in FIG. 1 by broken lines and is opened when the container 5 is mounted on the valve 4.

From the other end of the lower part 2 of the frame a support 9 projects upwards and there bears a dispensing connector 10 to which a dispensing closure 11 of a storage container 12 can be connected. The connector 10 is connected via a pipe 13 to the filling valve 4.

Figure 3:
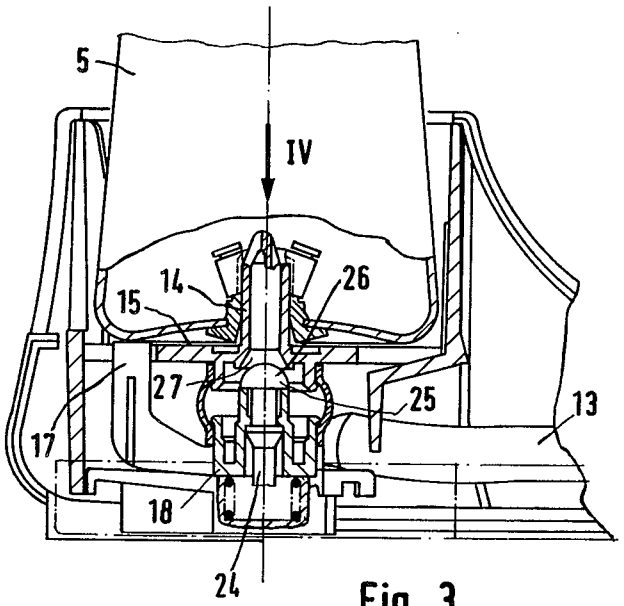
FIG. 3 shows, in a sectional illustration corresponding to FIG. 2, the state of the portion container when mounted.
Figure 4:
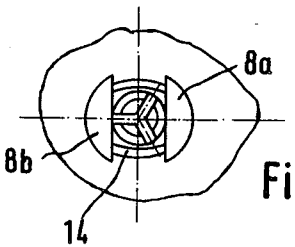
FIG. 4 shows a partial view in the direction of the arrow IV in FIG. 3.
Figure 2:
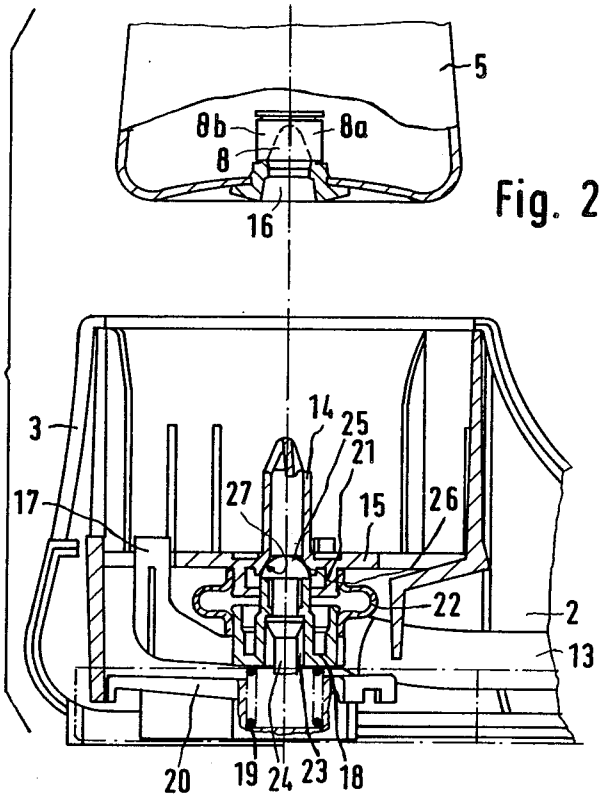
FIG. 2 shows an enlarged partial section through the decanting device in the region of the filling valve, above which the lower part of the container is illustrated.

As shown in detail in FIGS. 2 to 4, the filling valve 4 comprises an upwardly projecting hollow filling plug 14 which protrudes from a substantially horizontal base 15 for the portion container 5. When the container 5 is mounted, the plug 14 is introduced into its filling closure 8, which is provided with a central recess 16 and is made from resilient material, for example rubber. The part of the filling closure 8 projecting into the interior of the container 5 comprises two closure flaps 8*a*,8*b* which can be moved laterally from a closing position (FIG. 2) against their own spring force into an open position (FIG. 3). In the position shown in FIG. 3 the filling plug 14 projects into the container 5 so that the bore of the plug 14 is connected to the inner space of the container 5.

Three valve actuators 17 protrude from the base 15 and are connected to a lower, movable valve housing 18. The housing 18 is supported via a screw spring 19, against an insert 20 arranged in the lower part 2 of the frame.

The filling plug 14 and the base 15 are connected to an upper valve housing 21 which is rigidly connected with the frame and is preferably constructed in one piece therewith. The two valve housings 18 and 21 are connected by a bellows 22 so as to be leak-tight but relatively movable. The pipe 13 terminates in the space which is enclosed by the bellows 22 and lies between the valve housings 18 and 21.

In a central bore 23 of the lower valve housing 18 a valve closure member 24 is inserted, whose hemispherical head 25 forms on its outer side a curved sealing surface 26 which engages with a conical valve seat 27 on the lower end of the filling plug 14. When the container 5 is mounted on the base 15, as shown in FIG. 3, the valve actuators 17 are pressed downwards; they entrain the lower valve housing 18 and the valve closure member 24 so that the head 25 is lifted from the valve seat 27. The liquid located in the inner space of the filling valve 4 which subsequently flows through the pipe 13 rises in a container 5 to the desired level, which can be determined on the container 5 by markings. As soon as the desired liquid level in the container 5 has been reached, it is taken off again and all the parts return to the position shown in FIG. 2.

Figure 6:
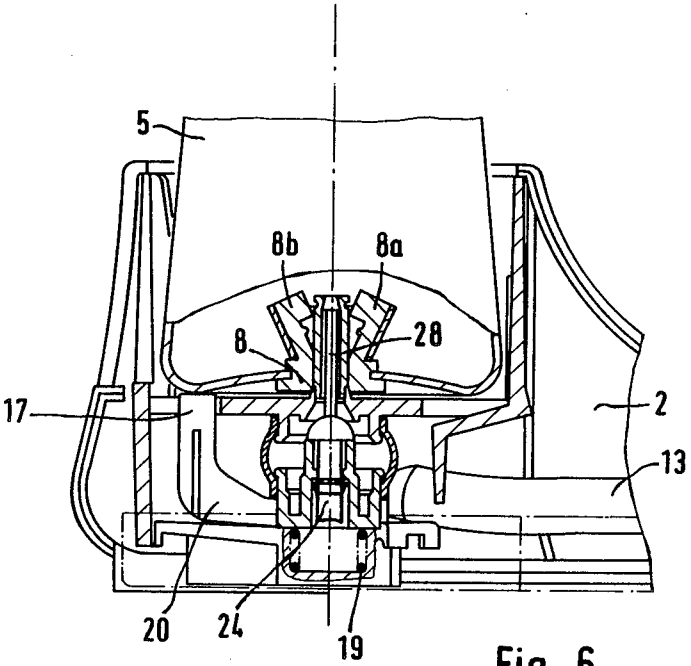
FIGS. 5 and 6 show a modified embodiment in illustrations corresponding to FIGS. 2 and 3, respectively.
Figure 5:
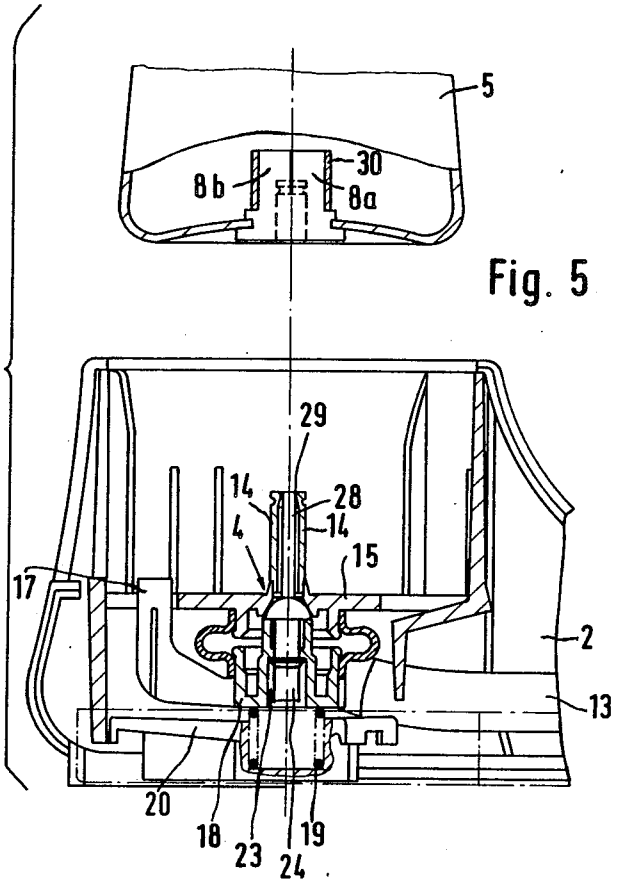

The embodiment shown in FIGS. 5 and 6, in which the same reference numerals are used for the same parts as in FIG. 1 to 4, differs from the previously described embodiment in that the valve closure member 24 is connected to a pin 28 projecting into the filling plug 14. In the closed state, the upper end of the pin 28 is in contact with an annular sealing surface 29 of the filling plug 14. Thereby not only is a double valve closure achieved but also the liquid remaining behind in the plug 14 when the filling valve 4 has been closed is prevented from drying up.

In a manner similar to that of the previously described embodiment the valve closure member 24 is sealingly inserted in the bore 23 of the lower valve housing 18 so as to be axially displaceable.

In FIGS. 5 and 6 it is further shown that the two closure flaps **8*a* and 8*b* of the filling closure 8 are pressed by a surrounding rubber ring 30 into their closing position (FIG. 5**).

Figure 7:
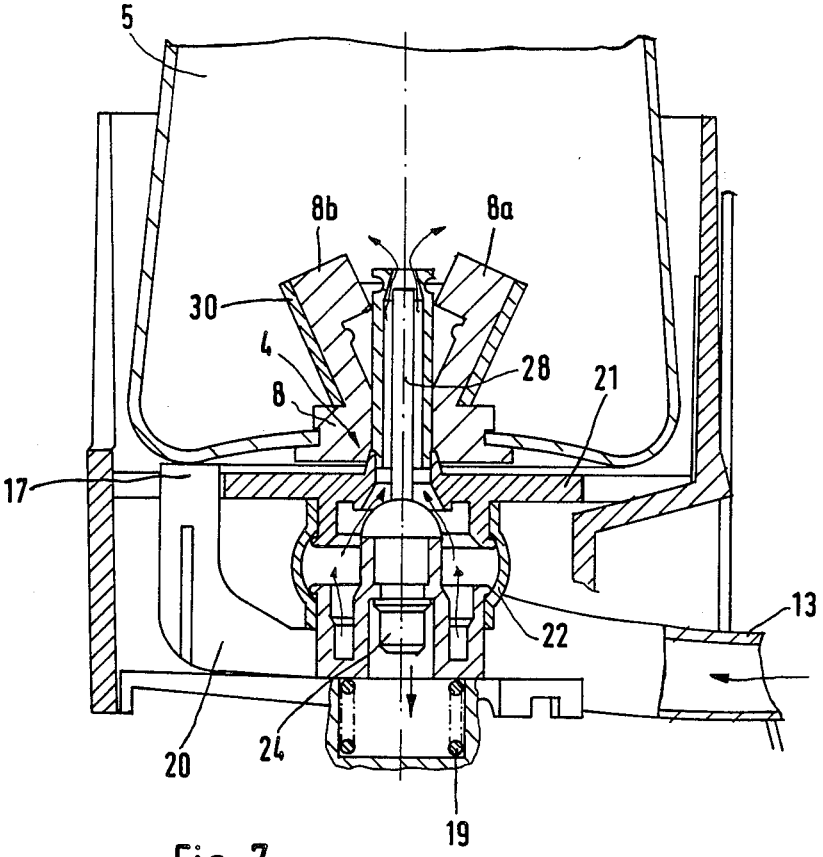
FIG. 7 shows an enlarged partial section through parts of the filling valve and the filling closure according to FIG. 6.

FIG. 7 is an enlarged partial section of FIG. 6 and shows parts of the filling valve 4 and the filling closure 8 of the portion container 5.

The storage container shown in the example according to FIG. 1 comprises in the original closed state (FIG. **1*a*) a stopper 31 within its dispensing closure 11 which is fitted on the base; the stopper 31 can be pressed into the interior of the container when the storage container 12 is mounted at a projection 32 of the dispensing connector 10. The dispensing closure 11 has an external thread 23 which in the closed state (FIG. 1*a*) bears a screw cap 34. After the cap 34 is taken off, the thread 33 is screwed into a connection thread 35 on the dispensing connector 10 and the stopper 31 is pushed upwards. The storage container 12 is thus connected to the pipe 13**.

In order to be able to ventilate the storage container 12 when liquid is removed a closable ventilation opening 36 is provided on its upper side.

Figure 8:
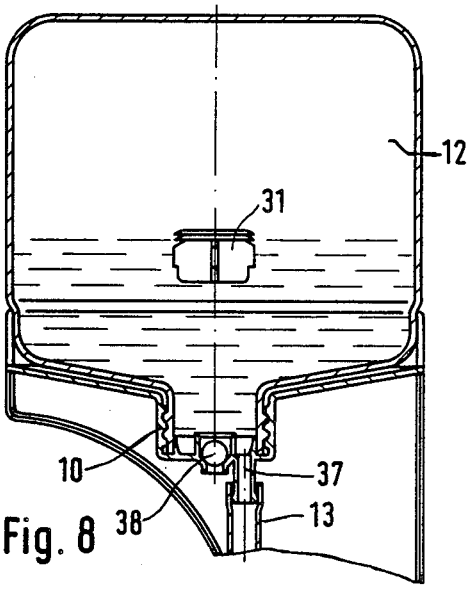
FIG. 8 shows in a vertical partial section a modified embodiment of a storage container connected to the dispensing connection part in vertical section.

Another way of ventilating the storage container 12 is illustrated in FIG. 8. In the dispensing connector 10 in addition to a dispensing opening 37 connected to the pipe 13 a spherical checkvalve 38 is arranged which forms a ventilation valve and allows the corresponding amount of air to enter when liquid is dispensed from the storage container 12.

Figure 9:
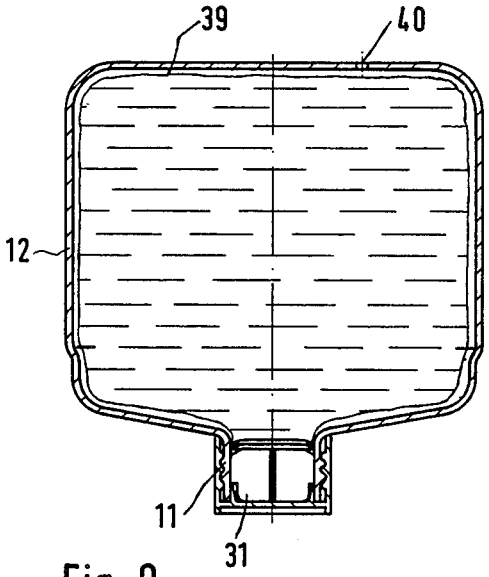
FIG. 9 shows in a vertical section another embodiment of a storage container in the closed state.

In the construction of the storage container 12 according to FIG. 9 no closable ventilation opening or ventilation valve is required. The liquid is contained in the storage container 12 in a foil bag 39, which is connected so as to be leak-tight to the dispensing closure 11. As the dispensing of the liquid continues, the foil bag 39 collapses. Contact of the liquid contained in the foil bag 39 with the surrounding air, which can flow in through a small ventilation bore 40 into the storage container 12, is completely prevented.

Figure 10A:
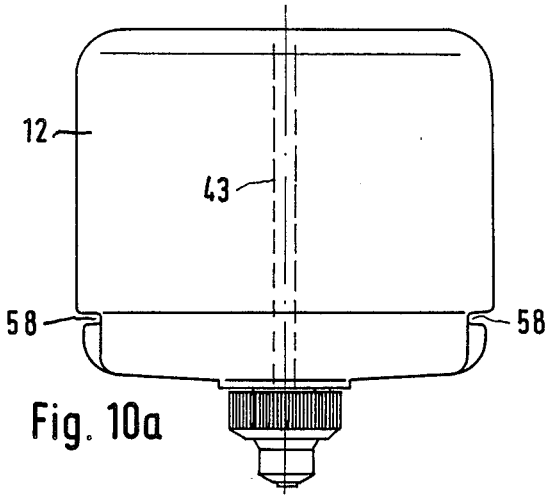
FIG. 10*a* shows the storage container used in the device according to FIG.10, the dispensing closure being shown in section.
Figure 10:
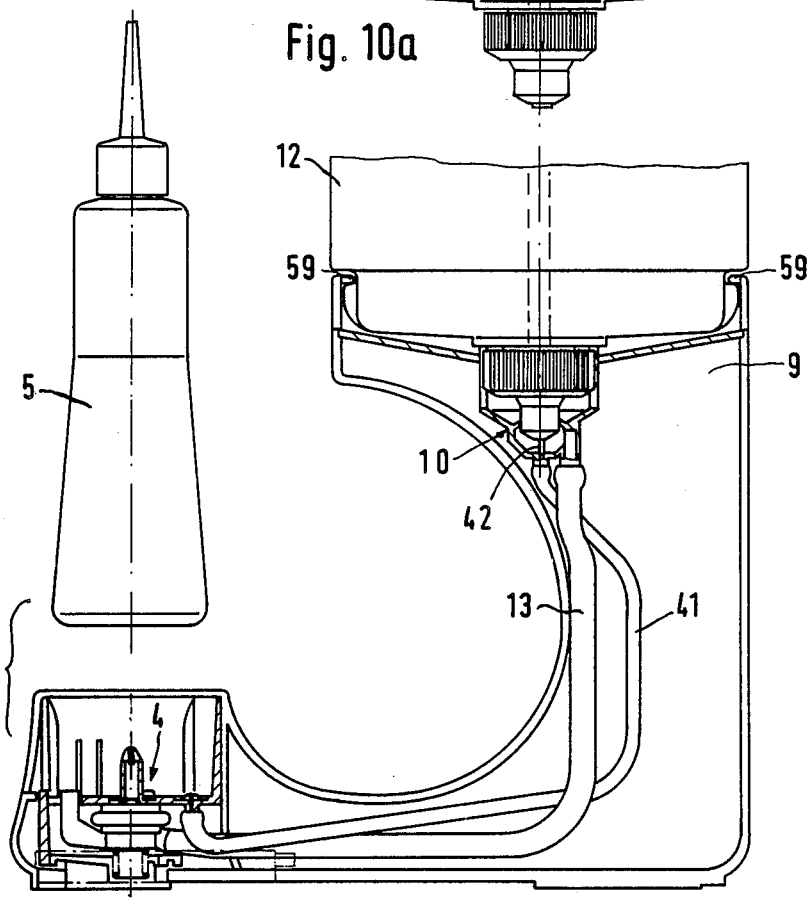
FIG. 10 shows, in an illustration corresponding to FIG. 1, an embodiment with a ventilation valve in the base for the portion container.
Figure 11:
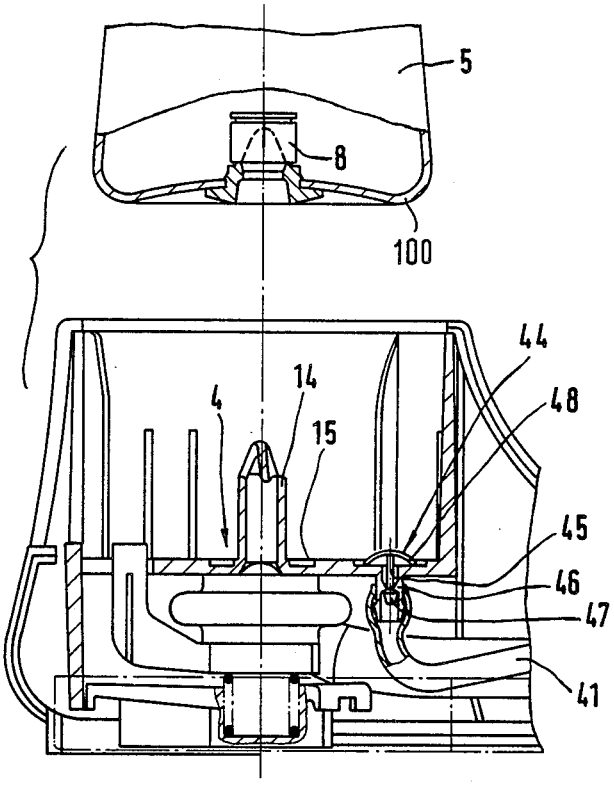
FIG. 11 shows the embodiment according to FIG. 10 in a partial section corresponding to FIG. 5.
Figure 12:
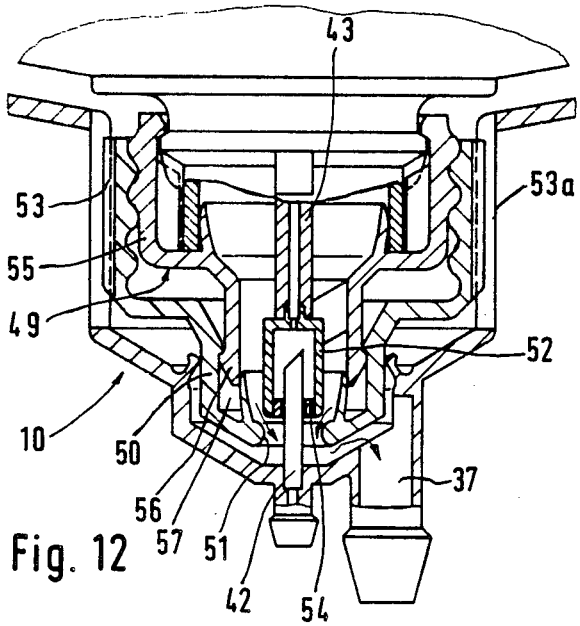
FIG. 12 shows an enlarged longitudinal section through the dispensing valve and the dispensing connection part according to FIG. 10 in the opened state.

In the embodiment according to FIGS. 10 to 12, in addition to the pipe 13 intended for the liquid, a ventilation line 41 is provided which leads from the filling valve 4 to the dispensing connector 10. The ventilation line 41 is connected at the base of the connector 10 to a hollow needle 42 (FIG. 12). The storage container 12 (FIG. **10*a*) comprises a ventilation pipe 43 projecting upwards from its dispensing closure, which in the mounted state of the storage container 12 is connected to the ventilation line 41** in a manner which will be further described subsequently.

Valve 4 serves to fill container 5. With reference to FIG. 10 it will be seen that valve 44 serves to vent the device via the hose conduit 41.

When filling valve 4 is actuated by the base 100 of the container 5 the ventilation valve 44 is simultaneously actuated also by the base 100 whereby the spring arm 48 of the plunger 45 is moved and the valve seat 46 is released, and valve 44 opens and thereby provides for air pressure compensation in the supply container 12 via the hose conduit 41.

Figure 13:
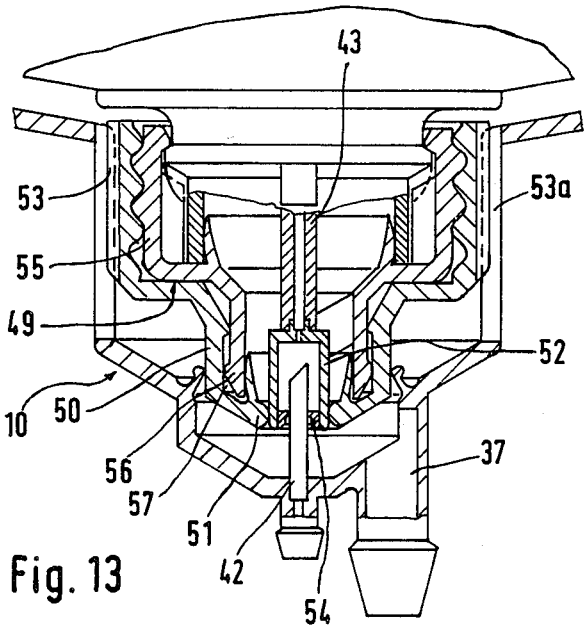
FIG. 13 shows, in a longitudinal section according to FIG. 12, the dispensing valve of the storage container in the closed state.

The mode of operation of the valve screw cap 50 is as follows:

The supply container 12 has at its lower end the valve screw cap 50, which is shown in FIG. 10 and 13, respectively, before and during its setting on the dispensing container 10. Container 12 is closed by the valve seat lip 51 before this container is set on the dispensing connector 10 and before a valve seat cylinder 52 is closed by a diaphragm 54. After applying container 12 on the dispensing connection 10 the diaphragm 54 is penetrated by the hollow pin 42 and thus establishes the connection with the ventilation conduit 41 seen in FIG. 10. By rotation of the container 12 which is axially immovably supported due to recesses 58 and projections 59, the connection between the valve seat lip 51 and the valve seat cylinder 52 is ceased (FIG. 12) while the connection with the opening 37 is established.

As FIG. 11 shows at detail on an enlarged scale, in the base 15 of the dispensing connector 4 in addition to the filling plug 14 there is a ventilation valve 44 whose valve actuator is a tappet 45 connected at its lower end to a valve closure member 47 which abuts at its base against an annular valve seat 46 and at its upper end is provided with spring arms 48 extending radially outwards and downwards. The part of the valve tappet 45 projecting above the base 15 is actuated by the base 100 of the portion container 5, so that the ventilation line 41 is only opened when the container 5 is completely mounted and thus the filling plug 14 is also connected to the filling closure 8 of the container 5 so as to be leak-tight. The ventilating valve 44 serves the purpose of compensating for an air under-pressure securing in the storage container 12 when the liquid is removed.

FIG. 22 shows in detail the structure of the dispensing closure of the storage container 12. In this case the closure is in the form of a dispensing valve 49 comprising a valve screw cap 50 which bears an inwardly projecting valve seat lip 51. In the closed state the lip 51 lies in the manner of a seal against a central valve seat cylinder 52 which is rigidly connected to the storage container 12. The cap 50 has longitudinal ribs 53 which extend axially parallel on its outside and into which guide ribs 53*a*—which also extend axially parallel—of the dispensing connector 10 engage, which in the illustrated embodiment are constructed as webs between slots of the connector 10.

The valve seat cylinder 52 is connected to the ventilation pipe 43 and is closed at its lower end with a diaphragm 54 which is perforated by the hollow needle 42 when the storage container 12 is mounted, in order to produce a connection between the ventilation pipe 43 and the hollow needle 42 connected to the ventilation line 41. As soon as a portion container 5 is mounted and thus the ventilation valve 44 is opened, the space lying above the liquid level in the storage container 12 is ventilated in this manner via the ventilation line 41 so that liquid can flow into the container 5. The liquid flows from the storage container 12 through the gap released between the valve seat lip 51 and the valve seat cylinder 52 downwards into the dispensing opening 37 to which the pipe 13 is connected.

In order to produce a sealing closure between the valve screw cap 50 and a container cap 55, an axially projecting cylinder attachment 56 is provided on the cap 55 fitted to the storage container 12, which attachment 56 engages in an axially extending sealing groove 57 of the valve screw cap 50 in the manner of a seal.

FIG. 13 shows the closed position in which the valve seat lip 51 abuts in the manner of a seal against the lower end on the outer side of the valve seat cylinder 52. When the valve screw cap 50 is screwed downwards the annular gap for removing the liquid between the valve seat lip 51 and the valve seat cylinder 52 is released.

In the embodiment according to FIGS. 10 to 12, the storage container 12 comprises laterally undercut recesses 58 (FIG. 10*a*) into which projections 59 mounted on the support 9 engage in the manner of a bayonet closure in the inserted state of the storage container 12. After inserting the storage container 12, however, the longitudinal ribs 53 of the valve screw cap 50 are also made to engage with the guide ribs 53*a* of the dispensing connector 10. When the storage container 12 is subsequently rotated in order to bring the bayonet closure parts 58,59 into engagement and thus to produce a rigid connection between the storage container 12 and the support 9, the valve screw cap 50 is rotated relative to the storage container 12 and thereby screw downwards. It is only by this screwing movement that the valve seat lip 51 comes out of engagement with the valve seat cylinder 52 and releases the removal gap so that liquid can issue from the storage container 12 into the line 13. Thereby any loss of liquid is prevented when the container is mounted and when dispensing is commenced.

Furthermore, in a corresponding manner at the end of dispensing, any loss of liquid is prevented because if necessary the storage container 12 must be rotated before being taken away from the support 9 in order to bring the bayonet closure parts 58,59 out of engagement. In this rotational movement the valve screw cap 50 is rotated upwards into its closing position so that it is ensured that the valve seat lip 51 and the valve seat cylinder 52 engage in the manner of a seal before the storage container 12 can be taken off.

When the storage container 12 is taken off, the hollow needle 42 is simultaneously pulled out of the diaphragm 54, the opening of which closes tight so as to be leak-tight.

It will be understood that each of the elements described above, or two or more together, may also find a useful application in other types of decanting devices differing from the types described above.

While this invention has been illustrated and described as embodied in a decanting device, it is not intended to be limited to the details above, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for decanting liquids, particularly liquid permanent wave agents, from a storage container provided with a dispensing closure into a receiver container provided at a base thereof with a filling closure and a discharge nozzle at which the receiver container is vented, comprising a frame having a lower part (2) and an upper part forming a support (9) for the storage container; a filling valve (4) connectable to the filling closure and including a base (15), a hollow filling tube (14) which projects upwardly from the base and is insertable into the filling closure of the receiver container when the latter is placed with its base onto the base of the filling valve, and at least one spring-loaded valve actuator (17) projecting upwardly from the base of the filling valve so that it is pressed by the base of the receiver container when the latter is placed onto the base of the filling valve to open said filling valve; a dispensing connector (10) connectable to said dispensing closure and mountable on said support so that it is positioned laterally offset of and above and at a vertical distance from said filling valve; and means for venting said storage container.

2. A device as claimed in claim 1, wherein said filling valve further includes a valve closure member (24), and the valve actuator (17) and the valve closure member (24) are connected to a movable lower valve housing (18) supported on a spring (19), the lower valve housing (18) being connected to an upper valve housing (21) which is rigidly connected with the frame and connected to the base (15) and the filling tube (14) by a movable valve housing seal (22).

3. A device as claimed in claim 2, wherein the valve housing seal is a bellows (22).

4. A device as claimed in claim 2, wherein the filling closure (8) of the receiver container (5) comprises at least two closure flaps (8*a*, 8*b*) movable from a closing position into an open position.

5. A device as claimed in claim 4, wherein the filling closure (8) is made from resiliently deformable material.

6. A device as claimed in claim 2, wherein the valve closure member (24) comprises a sealing surface (25) which engages with a conical valve seat (27) arranged at a lower end of the filling tube (14).

7. A device as claimed in claim 6, wherein the valve closure member (24) is connected to a pin (28) projecting into the filling tube (14), which pin (28) sealingly engages at an upper thereof with a sealing surface (29) in the filling tube (14).

8. A device as claimed in claim 2, wherein the valve closure member (24) is inserted into a central bore (23) of the lower valve housing (18) so that a seal is formed therebetween and so as to be axially displaceable.

9. A device as claimed in claim 1, wherein the storage container (12) is provided with lateral, undercut recesses (58) which receive in a mounted state of the storage container (12) projections (59) on the support (9).

10. A device as claimed in claim 9, wherein the dispensing closure of the storage container (12) is constituted by a dispensing valve (49) comprising a valve screw cap (50) bearing an inwardly projecting valve seat lip (51) which in a closed state sealingly lies against a central valve seat cylinder (52) which is rigidly connected to the storage container (12), the valve screw cap (50) having axially parallel longitudinal ribs (53) on its outside, the dispensing connector (10) having axially parallel ribs (53'a) which engage with the said longitudinal ribs (53).

11. A device as claimed in claim 10, wherein the dispensing valve (49) includes a cylinder attachment (56), which is connected to the storage container (12) and projects axially, sealingly engaging into an axially extending sealing groove (57) of the valve screw cap (50).

12. A device as claimed in claim 1, wherein the dispensing closure (11) of the storage container (12) comprises a closure stopper (31) which can be pushed into the interior of the storage container.

13. A device as claimed in claim 12 wherein the dispensing closure (11) of the storage container (12) comprises an external thread (33) which fits a connection thread (35) formed on the dispensing connector (10) of the support (9).

14. A device as claimed in claim 1, wherein the storage container (12) comprises a closable ventilation opening (36), said opening forming said venting means.

15. A device as claimed in claim 1 wherein the storage container (12) contains a foil bag (39) which is connected leak-tight to the dispensing closure (11).

16. A device as claimed in claim 1, wherein the dispensing connector (10) comprises a dispensing opening (37) and a ventilation valve constructed as a check valve (38), said ventilation valve forming said venting means.

17. A device as claimed in claim 1, wherein the dispensing connector (10) comprises a dispensing opening (37) and a ventilation connection (41) forming said venting means and which, when the storage container (12) is mounted is connected to a ventilation pipe (43) projecting upwardly from the dispensing closure (11) of the storage container (12) into an inner space of the storage container.

18. A device as claimed in claim 17, wherein a hollow needle (42) is fitted on the ventilation connection (43) and the dispensing closure (11) of the storage container (12) comprises a diaphragm (54) which closes the ventilation pipe (43) and can be perforated by the hollow needle (42).

19. A device as claimed in claim 1, wherein the dispensing connector (10) comprises a dispensing opening (37) and a ventilation connection (42) which, when the storage container (12) is mounted, is sealingly connected to a ventilation pipe (43) projecting upwardly from the dispensing closure (11) of the storage container (12) into an inner space of the storage container, and the base (15) in addition to the filling tube (14) is provided with a ventilation valve (44) forming said venting means and having a valve actuator (45) which projects upwardly above the base (15) and is connectable via a ventilation line (41) to the ventilation connection (42) in the dispensing connector (10).

20. A device as claimed in claim 19, wherein the ventilation valve (44) comprises a valve closing member (47) which lies against an annular valve seat (46), the valve closing member (47) being connected to a valve pin (45) which projects upwardly from the base (15).

21. A device as claimed in claim 20, wherein the valve tappet (45) is provided at its upper end with spring arms (48) which extend radially outwards and downwards.

* * * * *